United States Patent [19]

Buchla

[11] Patent Number: 4,558,623

[45] Date of Patent: Dec. 17, 1985

[54] VELOCITY AND AFTERTOUCH SENSITIVE KEYBOARD

[75] Inventor: Donald F. Buchla, Berkeley, Calif.

[73] Assignee: Kimball International, Inc., Jasper, Ind.

[21] Appl. No.: 577,854

[22] Filed: Feb. 7, 1984

[51] Int. Cl.[4] ..... G10H 1/34

[52] U.S. Cl. ..... 84/1.1; 84/1.27; 84/DIG. 7

[58] Field of Search ..... 84/1.09, 1.1, 1.27, 84/DIG. 7

[56] References Cited

U.S. PATENT DOCUMENTS

| | | |
|---|---|---|
| 3,507,970 | 4/1970 | Jones . |
| 3,715,447 | 2/1973 | Ohno . |
| 3,836,909 | 9/1974 | Cockerell . |
| 3,943,812 | 3/1976 | Nagai et al. . |
| 4,027,569 | 6/1977 | Luce et al. . |
| 4,033,219 | 7/1977 | Deutsch . |
| 4,213,367 | 7/1980 | Moog . |
| 4,416,178 | 11/1983 | Ishida . |

*Primary Examiner*—Stanley J. Witkowski

*Attorney, Agent, or Firm*—Albert L. Jeffers; John F. Hoffman

[57] ABSTRACT

A keyboard system for an electronic musical instrument of the keyboard type, such as an electronic organ, synthesizer or electronic piano. The keyboard is responsive to the velocity with which the key is depressed and controls the tone generation circuitry to produce tones of higher amplitudes for higher key depression velocities. The keyboard also includes an aftertouch control whereby further depression of the key past its normal limit against a compressible medium, such as a foam rubber or felt washer, alters the quality of the tone produced. For example, the aftertouch control could be used to vary vibrato, change pitch, change decay, and the like. A pickup for each key is positioned in an electric field set up between two electrodes, and the voltage impressed on the pickup will change depending on the position of the pickup within the field as determined by the amount of depression of the key. Polarity cancellation occurs at the point of full key depression, and depression of the key beyond this point into the aftertouch range causes the pickup to move into the portion of the field where it has an opposite polarity voltage impressed thereon. The signals from the pickups for the respective keys may be multiplexed and processed in a microcomputer controlled environment on a time shared basis.

27 Claims, 5 Drawing Figures

VELOCITY AND AFTERTOUCH SENSITIVE KEYBOARD

BACKGROUND OF THE INVENTION

The present invention relates to a touch responsive key arrangement for a keyboard controlled electronic musical instrument. In a preferred embodiment, the keyboard is responsive to depression velocity and aftertouch pressure.

In most prior art electronic keyboard musical instruments, such as electronic organs, synthesizers and electronic pianos, the depression of the playing keys closes a switch, and the switch closure is interpreted by the electronic circuitry to produce tones having frequencies corresponding to the depressed keys. In a velocity sensitive electronic piano, the amount of force or speed with which a key is depressed controls the amplitude of the resultant tone to thereby simulate the operation of an acoustic piano. In many prior art electronic pianos, a contact member is disconnected from one bus and then brought into contact with a second bus on full key depression, and the time of travel of the contact between the two buses is measured and the amplitude of the tone is altered in accordance therewith.

In many systems, the timing is accomplished by charging or discharging capacitors assigned to the respective keys. Alternatively, the number of discrete time elements, such as scans of the keyboard, that occur while the movable contact is moving between the two buses is detected. The higher the velocity with which the key is depressed, the shorter will be the time of transit between the two buses.

Some prior art keyboards include what is known as aftertouch control wherein further depression of the key after it has reached its normally depressed position alters the quality of the tone. The aftertouch sensing can be accomplished by a piezoelectric element contacted by the key or a lever attached to the key, by compressing a conductive compressible strip to alter the resistance thereof, or by altering the area of contact between a stationary contact member and a deformable contact member.

A disadvantage to keyboards that utilize actual switch closures to key the tones is that the switch contacts become dirty after a period of time thereby causing scratch and intermittent operation. Furthermore, there is the problem of switch bounce, which is particularly troublesome in digital instruments because the digital circuitry detects the switch bounce as repeated key closures whereas only one key closure is intended. Bounce must be overcome by utilizing switch debouncing circuitry.

Switch contacts can also become deformed so that different switches will close at different points in the depression of their respective keys. In velocity sensitive keyboards, such as those used in electronic pianos, inconsistencies in switch closure times will result in some keys producing tones of different amplitudes for a given key depression velocity, thereby resulting in non-uniform operation.

Uniform and predictable aftertouch control is particularly difficult to achieve when utilizing compressible resistive strips or piezoelectric elements, because their electrical characteristics may vary with time and use. Furthermore, electrical changes resulting from physical changes in the elements, such as in the case of the amount of compression of a resistive strip, is difficult to predict and control with the consistency that is desirable.

SUMMARY OF THE INVENTION

The keyboard system of the present invention, in accordance with a preferred embodiment thereof, overcomes the problems and disadvantages of prior art keyboards by providing a pickup for each key that is moved within an electrical field formed between a pair of electrodes. The pickup never contacts either of the electrodes, but the voltage impressed thereon will vary as a function of position within the field. Accordingly, as the key is depressed and the pickup is moved within the field, the voltage that is impressed thereon changes with the position of the key, and threshold detectors and other detection circuits can be utilized to detect when the key has reached critical points in its range of travel, such as its fully depressed position under normal force and the amount of aftertouch movement of the key.

A yieldable stop member for each key limits the downward movement of the key, and the position of the key when it engages the stop member is detected by the processing circuitry to indicate to a microcomputer, for example, that the key has been fully depressed. The amount of time for the pickup to move from the point where a first threshold voltage is detected to the point where the second threshold voltage indicative of full key depression is detected is measured and the amplitude of the generated tone is varied in accordance therewith. Depression of the key further against the yieldable stop member causes the voltage to change, and the amount of change is interpreted by the system to alter the quality of the generated tone in accordance with the amount of aftertouch pressure. For example, the vibrato or pitch deviation could be altered in a continuous fashion as a function of aftertouch pressure.

In the disclosed embodiment of the invention, AC voltages having opposite polarity and phase are impressed on the two electrodes so that the electric field produced between the electrodes has a position at a certain spacing from the electrodes that is at zero amplitude due to the polarity and phase cancellation. The system is adjusted so that depression of a key to its fully depressed position but before it is depressed into the aftertouch range, positions the pickup to the point of zero amplitude thereby providing an easily detectable reference point for full key depression. Further movement of the pickup past the point of zero amplitude moves it into an area of opposite voltage polarity, and the magnitude of this voltage polarity indicates the amount of pressure with which the key is depressed against the resilient stop into the aftertouch range.

The keyboard system of the present invention provides, in accordance with one form thereof, a pair of electrode members, respective voltages impressed on the electrode members to establish an electrical field between them, the field having a voltage that changes as a function of distance from one of the electrode members, and a movable pickup positioned in the field. The pickup is located between and spaced from the electrodes and has a voltage impressed thereon by the electric field that is a function of the closeness of the pickup to one of the electrode members. A playing key is depressible by a person playing the instrument and is connected to the pickup in such a manner that the pickup is moved within the field toward and away from the electrode member in accordance with the depression of the key. Means connected to the pickup senses the voltage impressed thereon and controls a quality of the tone produced by the instrument in response to the sensed voltage as the key is depressed.

The invention also provides, in accordance with one form thereof, a keyboard system for a keyboard controlled musical instrument having a first electrode member having a voltage impressed thereon, a second electrode member spaced from the first member and having a second voltage different from the first voltage impressed thereon to thereby establish an electric field between the electrodes, the field having a voltage gradient in a direction toward one of the electrodes. A movable pickup is positioned in the electric field between and spaced from the electrodes, the pickup not electrically contacting either of the electrodes and having a voltage impressed thereon by the electric field corresponding to the position of the pickup in the field. A playing key connected to the pickup moves the pickup either toward or away from the one electrode when the playing key is actuated, the pickup remaining electrically out of contact with the electrodes through its entire range of movement. Means connected to the pickup senses the voltage impressed thereon and controls a quality of the tones produced by the instrument in response to the sensed voltage.

The invention further provides, in one form thereof, a keyboard system comprising a playing key movable between a rest position and a normally depressed position, and a yieldable stop for engaging the key when the key is in its normally depressed position and yieldably resisting further depression of the key except under increased depression force. The key is depressible into an overtravel range past its normally depressed position against the resilient stop with increased depression force being applied thereto. An electric field is produced that varies in character as a function of position in the field, such as varying in amplitude and polarity. A pickup is connected to the key and is movable in the field in accordance with the amount of depression of the key, the pickup having a voltage impressed thereon by the field that varies in character in accordance with the position of the pickup in the field. Detection circuitry connected to the pickup and responsive to the character of the voltage impressed on the pickup detects when the key has reached its normally depressed position and further detects the amount of overtravel of the key when it is depressed past its normally depressed position. The detection circuitry alters the quality of the tone produced by the instrument in response to the character of the voltage impressed on the pickup.

In yet another form of the invention, a keyboard system for a keyboard controlled musical instrument comprises a first electrode member, a second electrode member spaced from the first member, and means for impressing respective voltages on the electrode members to establish an electrical field between the members, the field changing as a function of position between the electrode members. A plurality of playing keys each movable from a rest position to a normally depressed position and movable in an overtravel range past the normally depressed position are provided. Stops yieldably limit the depression of the keys to their normally depressed positions when their respective keys are pressed with normal force, yet permit the keys to overtravel when they are pressed with higher than normal force. A plurality of pickups connected to the respective keys are positioned within the electric field between the electrodes, the pickups being moved by the respective keys and having voltages impressed thereon by the field that are functions of their respective positions within the field. Circuitry connected to the pickups senses the voltages impressed thereon to detect for each key whether the key is undepressed, is in its normally depressed position, or is in its overtravel range of movement and, if in overtravel, the extent of overtravel. A tone generation system is responsive to the sensing circuitry for producing tones selected by depressed keys and varying the quality of the produced tones in accordance with the voltages impressed on the respective pickups.

Still further, the invention provides, in one form thereof, a keyboard system for a keyboard controlled musical instrument comprising a first electrode member, a second electrode member spaced from the first member, and means for impressing an AC voltage of a first phase and polarity on the first electrode and impressing an AC voltage of opposite phase and polarity on the second electrode. A plurality of playing keys are provided wherein each key is movable from a rest position to a normally depressed position and is movable in an overtravel range past the normally depressed position. Stops yieldably limit the depression of the keys to their normally depressed positions when their respective keys are pressed with normal force, yet permits the keys to overtravel past the normally depressed position when their respective keys are depressed with higher than normal force. A plurality of pickups are connected respectively to the playing keys and are located between the electrode members and spaced from the electrode members, the pickups being movable toward and away from the electrode members in accordance with the extent of the respective key depression.

It is an object of the present invention to provide a keyboard system for an electronic musical instrument utilizing a pickup which does not make direct electrical contact with the stationary electrodes.

It is a further object of the present invention to provide a keyboard system which is sensitive to the velocity with which the key is struck, and includes aftertouch control for modifying the quality of the tone in accordance with the overtravel of the key.

A still further object of the present invention is to provide a keyboard system for a musical instrument that is inexpensive yet reliable in operation.

These and other objects of the present invention will be apparent from the description which follows considered together with the appropriate drawing figures.

DETAILED DESCRIPTION

Figure 1:
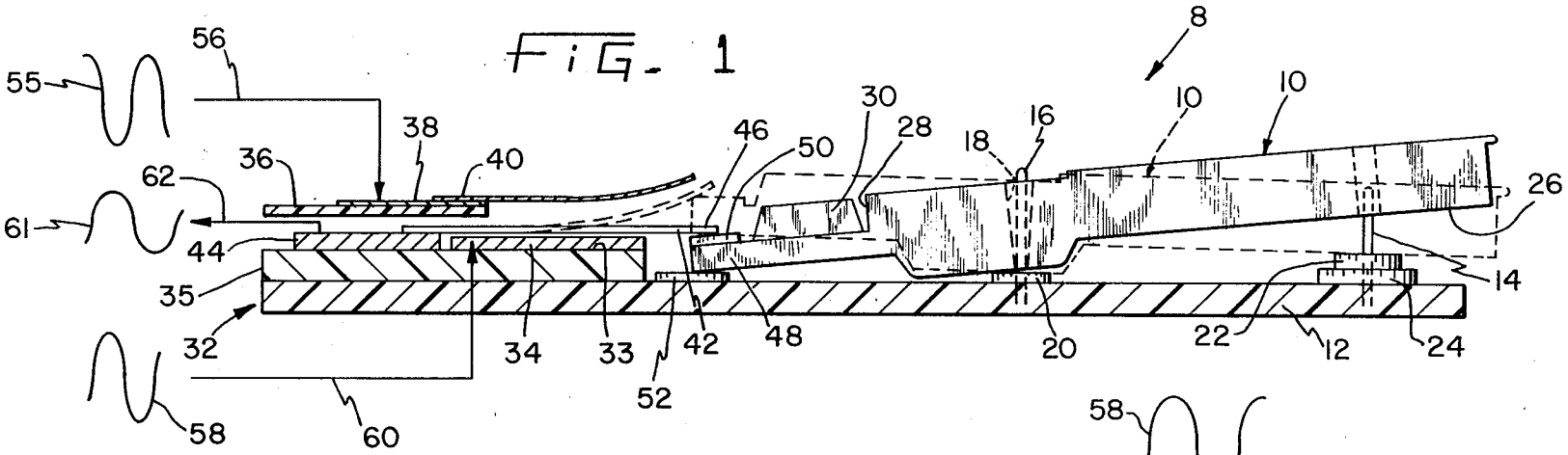
FIG. 1 is a diagrammatic, side elevational view of the keyboard showing the key in its rest position in solid line and in its normally depressed position in dotted line.
Figure 2:
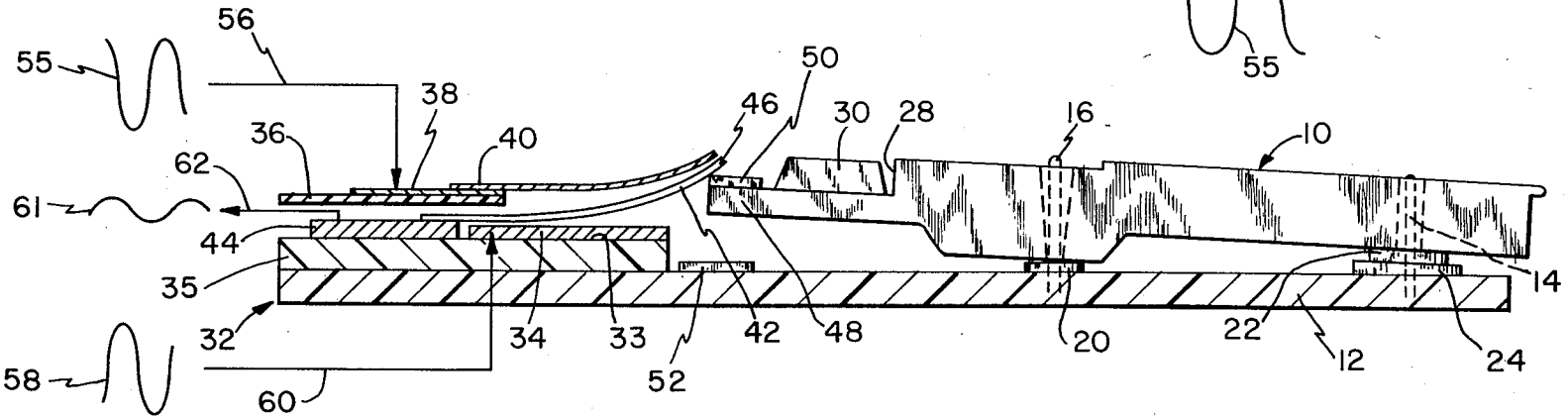
FIG. 2 is a sectional view similar to FIG. 1 wherein the key has been depressed past its normally fully depressed position to an overtravel condition.

Referring to FIGS. 1 and 2, the keyboard 8 of a preferred embodiment of the present invention comprises a plurality of playing keys 10 which are linearly arranged in the usual fashion as in a piano or organ keyboard. Playing keys 10 may be made of wood, for example, and coated with a plastic and are supported on a base 12. A pair of pins 14 and 16 are secured to base 12 and serve as the guide and pivot, respectively, for playing key 10. Pin 16 is received within an opening 18 within the center portion of key 10, and a felt or foam rubber washer 20 is disposed around pin 18 and serves as the fulcrum point for key 10. Pin 14 is likewise secured to base 12 and a pair of compressible, resilient washers 22 and 24 made of foam rubber are disposed around it and positioned such that the lower surface 26 of key 10 contacts them when key 10 is pressed by the performer to its normally fully depressed position. Since the cushions or washers 22 and 24 are compressible, key 10 can be depressed past its normally fully depressed position to compress washers 22 and 24 as illustrated in FIG. 2. The greater the force or "aftertouch" which is applied to key 10, the further that washers 22 and 24 will be compressed.

The rearward end of key 10 has a rabbet 28 cut therein, and a 1.5–2.0 oz. weight 30 is supported thereon for the purpose of giving keys 10 the feel of a normal piano action. Although a particular structure for playing key 10 has been described, it is only exemplary and other key constructions can be utilized.

A printed circuit board 35 is attached to the rearward end 32 of base 12 and carries on its upper surface 33 a continuous strip 34 of electrically conductive metal, such as copper or aluminum, running the entire length of keyboard 8. Since base 12 is made of electrically insulating material, strip 34, which functions as one of the electrodes, is electrically isolated therefrom. Printed circuit board 36, which is also supported on base 12, has provided thereon a strip of conductive material 38 and upper electrode 40, which may be made of copper or aluminum, is in electrical contact with strip 38.

A plurality of flexible copper pickup strips 42, one for each key 10 of keyboard 8, are electrically connected to a plurality of electrically conductive areas 44 on printed circuit board 35, and are spaced from and electrically out of contact with upper and lower electrodes 40 and 34. The free ends 46 of pickups 42 are positioned to be engaged by the ends 48 of keys 10, so that as keys 10 are depressed, the respective pickups 42 will be bent upwardly as shown in FIGS. 1 and 2. Felt pads 50 and 52 serve to cushion the impact of the end 48 of key 10 against pickup strip 42. It will be noted that upper electrode 40 is curved in somewhat the same manner as the curvature imparted to pickup strip 42 when it is bent upwardly by key 10.

A sinusoidal voltage 55 of negative polarity is connected to upper electrode 40 through conductive strip 38 and input lead 56. A sinusoidal voltage 58 of positive polarity and opposite phase is connected to lower electrode 34 through input lead 60. The voltage carried by electrodes 34 and 40 establishes between them an electrical field that impresses on pickups 42 respective voltages which are a function of the positions of the pickups 42 with respect to electrodes 34 and 40. The closer that pickup 42 is to lower electrode 34, the higher the amplitude contribution will be for the positive polarity voltage 58. Since voltages 55 and 58 add together to produce the electric field between electrodes 34 and 40, there will be a voltage gradient in directions toward and away from electrodes 32 and 40, so that the voltage which is present on pickup 42 will vary as a function of the contribution of the opposite polarity and out of phase voltages 55 and 58.

Figure 3:
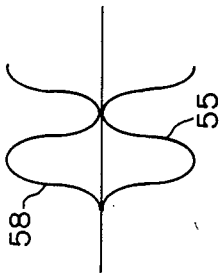
FIG. 3 is a diagrammatic view showing the polarity and phase relationship of the voltages carried by the electrodes.

For example, with key 10 at rest as is shown in the solid line position in FIG. 1, pickup 42 will carry a voltage which is nearly equal in amplitude to voltage 58 connected to lower electrode 34 because of the close proximity of pickup 42 to electrode 34. When key 10 is depressed to its normally fully depressed position, which occurs when it contacts washers 22 and 24, pickup 42 will be raised to the dotted line position shown in FIG. 1 which brings it closer, to upper electrode 40 and further away from lower electrode 34. By adjusting the voltages 55 and 58 applied to electrodes 40 and 34 and the geometrical spacing between pickup 42 and electrodes 34 and 40, the voltage in the electric field at this point can be made substantially zero due to the phase and polarity cancellation between voltages 55 and 58 as illustrated in FIG. 3. In the preferred embodiment, positive polarity voltage 58 is always positive and negative polarity voltage 55 is always negative, and because the phases of the two voltages 55 and 58 are 180° opposite, they cancel each other at the position of pickup 42 when key 10 is fully depressed For key 10 to be further depressed into the overtravel range, as illustrated in FIG. 2, it must be done with a force sufficient to compress washers 22 and 24. This further raises pickup 42 to a position closer to upper electrode 40, such that the voltage 61 produced on output 62 of pickup 42 will be negative and of the same phase as the voltage 55 applied to upper electrode 40. The further that key 10 is depressed, the further pickup 42 will be raised toward upper electrode 40 thereby causing the amplitude of voltage 61 to increase. Accordingly, the voltage 61 on the output 62 of pickup 42 during the overtravel or aftertouch range of key 10 will be a function of the pressure applied to key 10 by the performer. This aftertouch voltage can be used to control a variety of tone quality parameters, such as vibrato depth, frequency shift, decay alteration, and the like.

Although the keyboard arrangement shown in FIGS. 1 through 3 utilizes sinusoidal voltages 55 and 58 of opposite polarity and phase, alternative arrangements are possible. For example, DC voltages of opposite polarity could be impressed on electrodes 34 and 40 so that the voltage impressed on pickup 42 by the electrostatic field would be a variable DC voltage changing in accordance with the depression of key 10. Furthermore, ground potential could be connected to one of the electrodes 34 and 40 and a voltage connected to the other electrode so that the position of key 10 would change the amplitude of the voltage impressed on pickup 42 without regard to polarity.

However, it is preferred that the opposite polarity and opposite phase AC voltages 55 and 58 be utilized and that a zero voltage signal be impressed on pickup 42 at the time of full key closure. A zero voltage condition is easy to detect, and since this is the point in the travel of the key 10 where it goes from a normal depression into the aftertouch or overtravel range, it is convenient to be able to easily distinguish between these two positions of key 10 as indicated by the polarity of the signal. This is particularly true when the overtravel signal is utilized to call forth a totally different tone parameter, such as a frequency shift, filter variation, or the like.

Although the disclosed arrangement is preferred, pickup 42 need not be deformed in the manner illustrated. Furthermore, it could be moved or deformed by interconnecting linkage other than the end of key 10. In short, a variety of alternative arrangements are possible, with only the preferred embodiment being disclosed in detail herein.

Figure 4:
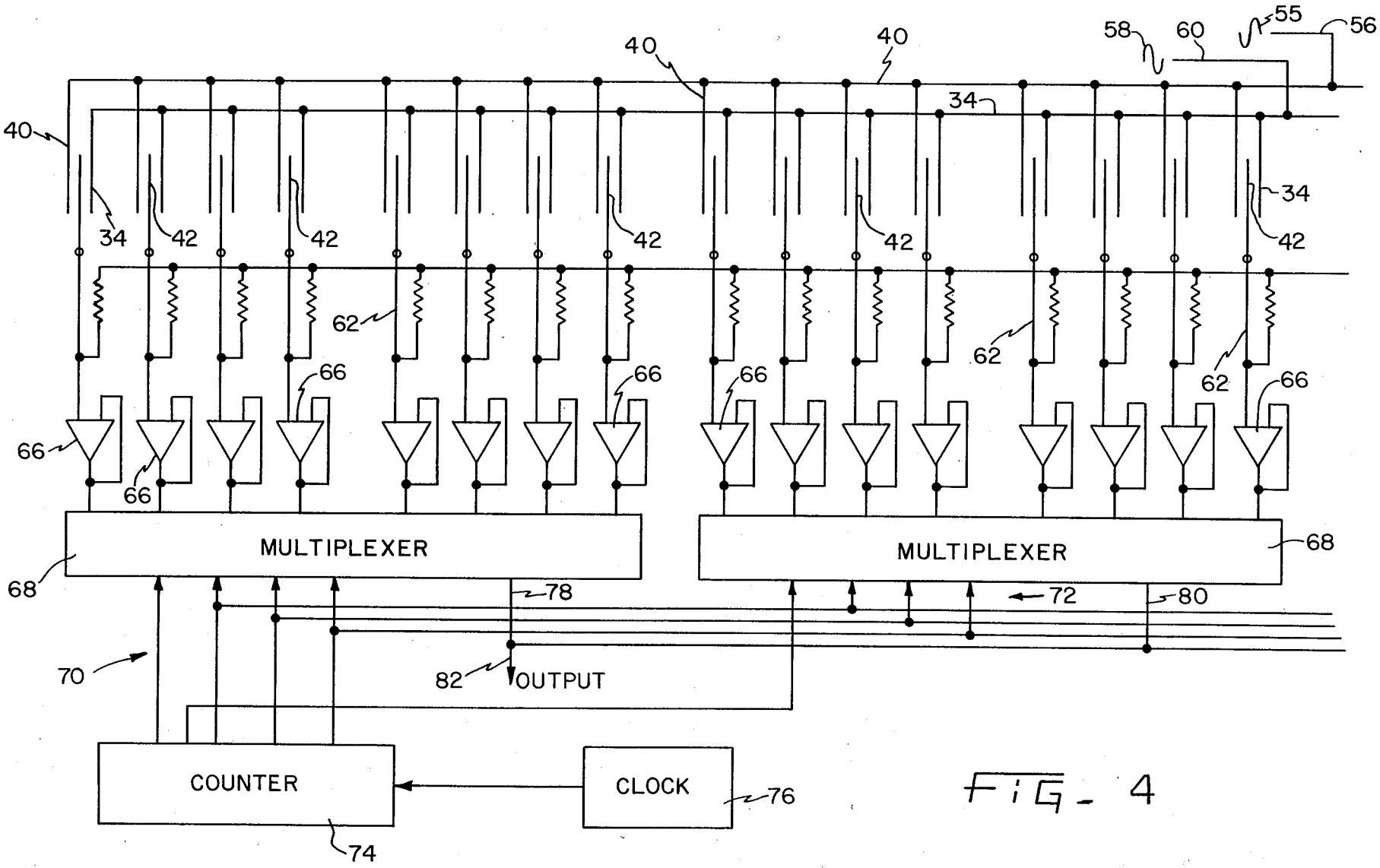
FIG. 4 electric schematic of the keyboard multiplexing system.

Referring now to FIG. 4, one half of the sixty-one key keyboard 8 is illustrated schematically to show how the output voltages on lines 62 from pickups 42 can be multiplexed. Upper electrode 40 and lower electrode 34 are shown schematically, and it will be seen that pickups 42, which are positioned between them, are connected to respective source follower op amps 66, which provide the proper amplification to the low current signals on pickups 42 for input to multiplexers 68. Multiplexers 68 are driven by drive lines 70 and 72 from counter 74, which in turn is driven by clock 76. Receive lines 78 and 80 are combined to produce on output line 82 time division multiplexed analog voltage levels sampled from pickups 42. The circuitry of FIG. 4 would be duplicated for the other half of keyboard 8.

Figure 5:
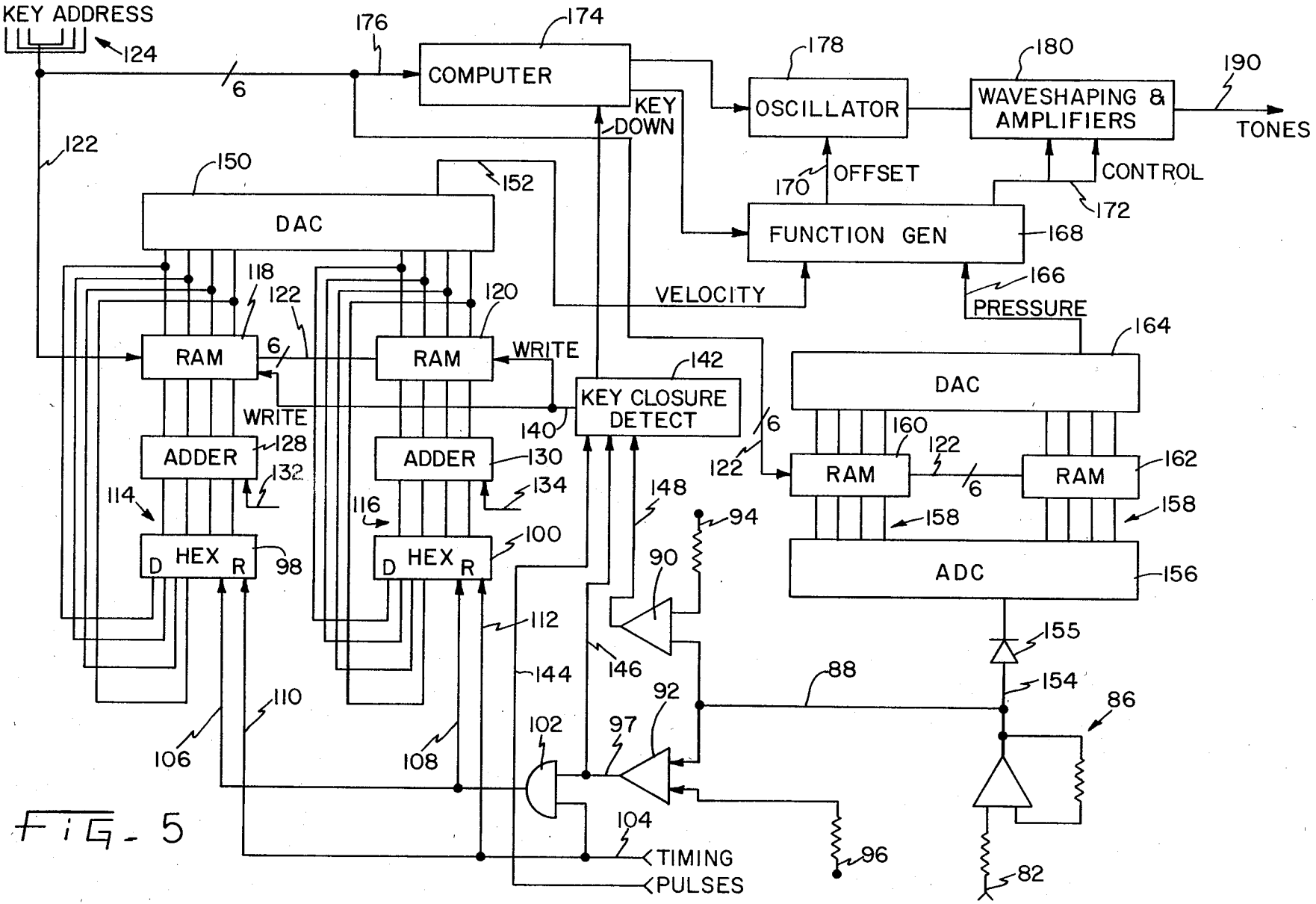
FIG. 5 is a block diagram of the system for processing the keyboard data.

FIG. 5 illustrates in simplified block diagram form a possible implementation for the keyboard system disclosed in FIGS. 1 and 2. The multiplexed analog voltage values from output line 82 of multiplexers 68 are inverted by op amp 86 such that the previously positive voltages during the excursion of key 10 in its normal range of travel become negative voltages, and the previously negative voltages indicating the pressure data have become positive voltages.

The voltages are connected by line 88 to a pair of comparators 90 and 92 that have reference voltages next to their other inputs by lines 94 and 96, respectively.

Comparator 92 operates as a key release detector so that when the key has been depressed slightly, thereby decreasing the voltage on its pickup 42, the threshold voltage of comparator 92 will be reached and its output on line 97 will be anded together with a timing pulse on line 104 by and gate 102 to thereby reset hex D flip-flops 98 and 100 via lines 106 and 108. In synchronism with the scanning of keyboard 8, flip-flops 98 and 100 will be clocked by signals on lines 110 and 112 to latch to their outputs 114 and 116 the eight bit value read out of random access memories 118 and 120, which are addressed by a six bit key address word on lines 122 from key address input 124, which has a unique address for each key of keyboard 8. On each scan of keyboard 8, the inputs 114 and 116 to full adders 128 and 130 will be incremented by an amount which appears on inputs 132 and inputs 134, respectively. This incremented amount is then written into RAMs 118 and 120 in accordance with a write signal on line 140 from key closure detect circuit 142. Key closure detect block has an input 144 which carries a timing pulse and an input from key release comparator 92. Comparator 90 is a key closure comparator which produces a signal on output 148 to key closure detect block 142 when the key for the time slot being addressed at that time reaches its fully depressed condition, as evidenced by a zero voltage signal on pickup 42 (FIGS. 1 and 2).

The write signal on line 140 from key closure detect circuit 142 causes the incremented value to be written into RAMs 118 and 120 until the key has been fully depressed, at which time that location in RAMs 118 and 120 assigned to the particular key in question will be incremented no further, unless the key is released and re-struck.

The circuit just described functions as a timer to increment the values in RAMs 118 and 120 on each scan of the keyboard beginning with the time of transition of the key 10 from the point where it is slightly depressed, thereby triggering comparator 92, to the point where it is fully depressed, thereby triggering comparator 90. The higher the velocity with which the keys are struck, the lower will be the values stored in RAMs 118 and 120. Rather than incrementing the stored value on each scan of the keyboard by a fixed amount, the inputs 132 and 134 could be connected from RAMs 118 and 120 so that the amount of change on each cycle changes exponentially.

Digital to analog converter 150 converts the eight bit velocity word to an analog voltage on output 152 which, since the system is operating in a time shared fashion, changes for each key slot.

The pressure voltages on line 154, which are now of positive polarity due to the inversion by op amp 86, are connected through diode 155 to analog to digital converter 156, which converts the pressure values to eight bit words on outputs 158, and these words are stored in the appropriate locations within RAM 160 and 162, which are addressed by the same address signal on line 122 as are RAMs 118 and 120. Digital to analog converter 164 converts the digital pressure signals into an analog signal on line 166.

The analog velocity value on line 152 and the analog pressure value on line 166 are connected to inputs of function generator 168, which is an analog processor that produces on its outputs 170 and 172 a variety of control signals, depending on the instructions from microcomputer 174. Microcomputer 174, which may be a Zilog Z-80 microcomputer, for example, keeps track of the key being addressed by virtue of the six bit address word on its input 176. Microcomputer 174 can instruct function generator 168 to act on one or both of inputs 152 and 166 carrying the velocity and pressure data to produce a variety of outputs on 170 and 172 connected to oscillator 178 and wave shaping circuit 180, respectively. For example, microcomputer 174 can instruct function generator 168 to change the control signal on a voltage controlled amplifier within wave shaping and amplifier block 180 in accordance with a particular velocity level signal on input 152, after the key for that particular time slot has been fully depressed. Alternatively, function generator 168 could be instructed to interpret the pressure input on line 166 to produce a frequency offset signal on input 170 to oscillator 178, which may result in a small deviation of the pitch of the signal, implement vibrato, change vibrato, and the like. By way of further example, function generator 168 could be instructed by microcomputer 174 to alter the Q of a filter or alterate filter depth setting within wave shaping and amplifier block 180. In short, the velocity and pressure inputs to function generator 168 can be utilized in a variety of ways to alter the quality of the tones that appear on output 190 by modification of the oscillator, filter and amplifier functions within blocks 178 and 180.

Although a specific environment for the keyboard system of the present invention has been shown in FIGS. 4 and 5, other implementations are possible. For example, the pressure and velocity data could be accessed directly by a microcomputer to control a digital oscillator or hybrid digital/analog system. Alternatively, the pressure and velocity data could be utilized by a full analog system in accordance with a more conventional synthesizer technology.

While the invention has been described as having a preferred design, it will be understood that it is capable of further modification. This application is, therefore, intended to cover any variations, uses, or adaptations of the invention following the general principles thereof and including such departures from the present disclosure as come within known or customary practice in the art to which this invention pertains and fall within the limits of the appended claims.

What is claimed is:

1. A keyboard system in a keyboard controlled musical instrument comprising:

a pair of electrode members, input means for impressing respective input voltages on said member to establish an electrical field between said electrode members, said electrical field having a voltage that changes as a function of distance from one of said electrode members, a movable pickup means positioned in said field between and spaced from said electrode members, said pickup means having an output voltage impressed thereon by the electrical field that is a function of the closeness of said pickup means to said one electrode member, a playing key depressible by a person playing the instrument, means connecting said playing key to said pickup means to move said pickup means within said field toward or away from said one electrode member in accordance with the depression of the key, and output means connected to said pickup means for sensing the output voltage impressed thereon and controlling the quality of a tone produced by the instrument in response to the sensed output voltage as the playing key is depressed.

2. The keyboard system of claim 1 wherein: said input means for impressing input voltages comprises means for impressing respective positive and negative input voltages on said electrode members whereby the electrical field has a zero voltage at a particular distance intermediate said electrode members, and said output means for sensing includes threshold means for detecting when the output voltage impressed on said pickup means is zero.

3. The keyboard system of claim 2 wherein the input voltages on said electrode members are AC voltages 180° out of phase.

4. The keyboard system of claim 3 wherein the AC voltages are sinusoidal.

5. The keyboard system of claim 2 including stop means for limiting the depression of the playing key to a first level when the key is depressed with normal playing force, said stop means being yieldable to permit overtravel of the playing key past the first level to at least one lower level when the key is depressed with a force greater than the normal playing force; said field having one of a positive and negative voltage at distances from said one electrode less than said particular distance and the other of a positive and negative voltage at a distance from said one electrode greater than said particular distance; said output means for sensing distinguishing between positive and negative output voltages impressed on said pickup means.

6. The keyboard system of claim 5 wherein said stop means comprises a compressible element mounted underneath said key.

7. The keyboard system of claim 2 including stop means for limiting the depression of a playing key to a first level when the key is depressed with normal playing force, said stop means being yieldable to permit overtravel of the playing key past the first level to at least one lower level when the key is depressed with a force greater than the normal playing force; said output means for sensing comprising a first threshold detector means responsive to a particular output voltage level impressed on said pickup means when said key is depressed to the first level and second threshold detector means responsive to the output voltage impressed on said pickup means as said key is depressed beyond the first level.

8. The keyboard system of claim 7 wherein said stop means comprises a compressible element mounted underneath said key.

9. The keyboard system of claim 1 wherein said pickup means comprises a flexible conductive strip engaged and moved by one end of said playing key.

10. The keyboard system of claim 9 wherein one end of said strip is connected to a printed circuit board and the other end of said strip is engaged and moved by said playing key one end as said playing key is depressed.

11. A keyboard system in a keyboard controlled musical instrument comprising: a first electrode member; first input means for impressing a first input voltage on said member; a second electrode member spaced from said first member; second input means for impressing a second non-zero input voltage different from said first input voltage on said second member to establish an electrical field between said electrode members, said field having a voltage gradient in a direction toward one of said electrode members; a movable pickup positioned in the electrical field between and spaced from said electrode members, said pickup not contacting either of said electrode members, said pickup having an output voltage impressed thereon by said electrical field corresponding to the position of the pickup in the field; playing key means connected to said pickup for moving said pickup one of toward and away from said one electrode member when a playing key means is actuated, said pickup remaining out of contact with said electrode member through its entire range of movement; and output means connected to said pickup for sensing the output voltage impressed thereon and controlling a quality of the tone produced by the instrument in response to the sensed output voltage.

12. The keyboard system of claim 11 wherein: said first and second input means for impressing first and second input voltages comprises means for impressing respective non-zero positive and negative input voltages on said electrode members whereby the electrical field has a zero voltage at a particular position intermediate said electrode members, and said output means for sensing includes threshold means for detecting when the output voltage impressed on said pickup means is zero.

13. The keyboard system of claim 12 wherein the input voltages on said electrode members are AC voltages 180° out of phase.

14. The keyboard system of claim 11 wherein said playing key is depressible by a person playing the instrument and including electrically nonconductive stop means for limiting the depression of a playing key to a first level when the key is depressed with normal playing force, said stop means being yieldable to permit overtravel of the playing key past the first level to at least one lower level when the key is depressed with a force greater than the normal playing force; said output means for sensing comprising a first threshold detector means responsive to a particular output voltage level impressed on said pickup means when said key is depressed to the first level and second threshold detector means responsive to the output voltage impressed on said pickup means as said key is depressed beyond the first level.

15. A keyboard system for a keyboard controlled musical instrument comprising:

a playing key movable between a rest position and a normally depressed position, yieldable stop means for engaging said key when the key is in its normally depressed position and yieldably resisting further depression of the key except under increased depression force, the key being depressible into an overtravel range past its normally depressed position against the stop means with increased depression force being applied thereto, field producing means for producing an electric field that varies in character as a function of position in the field, pickup means connected to said key and movable in the field by the key in accordance with the amount of depression of the key, said pickup means having an output voltage impressed thereon by the field that varies in character in accordance with the position of the pickup means in the field, and detection means connected to said pickup means and responsive to the character of the output voltage impressed on the pickup means for detecting when the key has reached its normally depressed position and for detecting the amount of overtravel of the key when it is depressed past its normally depressed position, said detection means altering the quality of the tone produced by the instrument in response to the character of the output voltage impressed on the pickup means.

16. The keyboard system of claim 15 wherein: the electric field is an AC field that varies in amplitude and polarity as a function of position, said pickup means has an output voltage of first polarity and varying amplitude impressed on it by the field as it is moved by the key during travel of the key between its rest and normally depressed positions, and the pickup means has an output voltage of opposite polarity and varying amplitude impressed on it as it is moved by the key in the range of overtravel movement.

17. The keyboard system of claim 16 wherein the output voltage impressed on said pickup means by the field is at zero amplitude at the position of the pickup means in the field when the key is in its normally depressed position.

18. The keyboard system of claim 17 wherein said stop means is a compressible cushion that is engaged by the key at its normally depressed position.

19. The keyboard system of claim 15 wherein said stop means is a compressible cushion that is engaged by the key at its normally depressed position.

20. The keyboard system of claim 15 wherein said field producing means varies the polarity and amplitude of the field as a function of position.

21. The keyboard system of claim 15 wherein said field producing means comprises: a first electrode, a second electrode spaced from the first electrode, and input means for placing an input voltage of first polarity on the first electrode and an input voltage of opposite polarity on the second electrode, the field having a null position of zero amplitude due to amplitude cancellation at said null position.

22. The keyboard system of claim 21 wherein said pickup means is positioned between the electrodes and is moved into said selected position of zero amplitude by the key when the key is in it normally depressed position.

23. The keyboard system of claim 21 wherein the input voltages are AC voltages 180° out of phase with each other.

24. A keyboard system in a keyboard controlled musical instrument comprising:

a first electrode member, a second electrode member spaced from said first electrode member, input means for impressing respective non-zero input voltages on said electrode members to establish an electrical field between the members, said field changing as a function of position between the electrode members, a plurality of playing keys each movable from a rest position to a normally depressed position and movable in an overtravel range past the normally depressed position, stop means for yieldably limiting depression of the keys to their normally depressed positions when the respective keys are pressed with normal force and for permitting the keys to overtravel past their normally depressed positions when the respective keys are pressed with higher than normal force, a plurality of pickup means connected respectively to said keys and positioned within the electrical field between said electrode members, said pickup means being moved by the respective keys within the field and having an output voltage impressed thereon by the field that is a function of position, output means connected to said pickup means for sensing the output voltages impressed on said plurality of pickup means to detect for each key whether the respective key is undepressed, is in its normally depressed position, or is in its range of overtravel movement, and if in overtravel, the extent of overtravel, and tone generation means responsive to said output means for producing tones selected by depressed keys and varying the quality of the produced tones in accordance with the output voltages impressed on the respective pickup means.

25. A keyboard system in a keyboard controlled musical instrument comprising:

a first electrode member, a second electrode member spaced from said first electrode member, input means for impressing an input AC voltage of a first phase and polarity on said first electrode member and impressing an input AC voltage of opposite phase and polarity on said second electrode member to establish an electrical field between the members, a plurality of playing keys each movable from a rest position to a normally depressed position and movable in an overtravel range past the normally depressed position, stop means for yieldably limiting depression of the keys to their normally depressed positions when the respective keys are pressed with normal force and for permitting the keys to overtravel past the normally depressed position when the respective keys are pressed with higher than normal force, and a plurality of pickup means connected respectively to said playing keys, said pickup means being positioned between the electrode members and spaced from the electrode members, said pickup means being moved, without contacting said members, toward and away from the electrode members in accordance with the extent of the respective key depressions.

26. The keyboard system of claim 25 wherein said stop means are a plurality of compressible cushions that are underneath respective said keys.

27. The keyboard system of claim 25 wherein the electrical field has a zero amplitude at a selected position in the field due to polarity cancellation, and said pickup means are moved to said selected position in the field by their respective keys at the normally depressed positions of the respective keys.

* * * * *